US006070720A

United States Patent [19]

Johnson

[11] Patent Number: 6,070,720

[45] Date of Patent: Jun. 6, 2000

[54] APPARATUS FOR DISPLAYING AND PROTECTING A GARMENT

[76] Inventor: Linda Faye Johnson, 720 Kennerly La., Imperial, Mo. 63052

[21] Appl. No.: 09/098,196

[22] Filed: Jun. 16, 1998

[51] Int. Cl.[7] ..... B65D 85/18

[52] U.S. Cl. ..... 206/279; 206/286; 206/287; 206/292; 206/297; 383/907

[58] Field of Search ..... 383/907; D9/311, D9/316, 269; 206/295, 822, 279, 286, 287, 292, 297

[56] References Cited

U.S. PATENT DOCUMENTS

| | | | |
|---|---|---|---|
| D. 69,387 | 2/1926 | Goldsmith | 383/907 X |
| D. 152,173 | 12/1948 | Seidler | 383/907 X |
| 1,021,593 | 3/1912 | Gilkerson | 206/297 X |
| 1,876,238 | 9/1932 | Johnson | 206/286 X |
| 3,098,561 | 7/1963 | Kass | 206/287 |
| 3,172,531 | 3/1965 | Shillman | 206/287 X |
| 5,154,329 | 10/1992 | Dorfmueller | 206/296 X |

*Primary Examiner*—Stephen P. Garbe
*Assistant Examiner*—Tri M. Mai
*Attorney, Agent, or Firm*—Haverstock, Garrett & Roberts LLP

[57] ABSTRACT

Apparatus for displaying and protecting a garment in an unfolded, substantially visible condition, the apparatus including a generally planar backing member including a body portion and at least two limb portions attached to the body portion at locations corresponding to the locations of limb receiving members of the garment, the limb portions of the backing member being preferably bendable relative to the body portion to allow insertion of the backing member into the garment such that the limb portions are received in arm or leg portions of the garment, and a protective envelope constructed of overlapping generally transparent film members having outer peripheral edge portions joined together forming an interior cavity adapted for receiving the backing member when located in the garment, the backing member and the protective envelope each having a profile shape corresponding to the profile shape of the garment when in an unfolded condition, the protective envelope being marginally larger for receiving the backing member when located in the garment.

20 Claims, 7 Drawing Sheets

APPARATUS FOR DISPLAYING AND PROTECTING A GARMENT

The present application relates generally to apparatus for displaying and protecting a garment, and more particularly, to apparatus for displaying and protecting a garment in an unfolded condition wherein substantially all of both the front and rear outer surfaces of the garment are visible.

1. Background of the Invention

Currently, a wide variety of devices are known for storing, displaying and protecting garments. Reference, for instance, U.S. Pat. No. 5,718,331; U.S. Pat. No. 5,372,414; U.S. Pat. No. 5,358,106; U.S. Pat. No. 4,046,253; U.S. Pat. No. 1,879,739; U.S. Pat. No. 1,878,771; and U.S. Pat. No. 1,335,972. However, such known devices have been found to suffer from shortcomings in that they do not provide economical and simple means to support and display the garment in an unfolded condition with the front and rear surfaces thereof substantially completely visible.

Accordingly, it is the principal object of the present invention to overcome the problems and shortcomings identified above.

2. Disclosure of the Invention

In one aspect of the present invention, apparatus for displaying and protecting a garment in an unfolded, substantially visible condition is disclosed, the present apparatus including a generally planar backing member of at least generally rigid construction including a body portion and at least two limb portions attached to the body portion at locations corresponding to the locations of limb receiving members of the garment such as sleeves, pant legs and the like, the limb portions of the backing member being optionally and preferably bendable relative to the body portion thereof to allow insertion of the backing member into the garment with the limb portions received in the limb receiving members of the garment, the backing member having an outer profile shape corresponding at least generally to an outer profile shape of the garment when viewed from the front or rear such that substantially all of the front outer surface and the rear outer surface of the garment are visible, the apparatus further including a protective envelope constructed of overlapping generally transparent film members having outer peripheral edge portions joined together forming an interior cavity between the film members adapted for receiving the backing member when located in the garment, the protective envelope having a profile shape defined by the outer edges of the overlapping film members corresponding to and marginally larger than the profile shape of the backing member, the protective envelope having an opening communicating with the interior cavity thereof adapted for the passage of the garment with the backing member located therein into and out of the interior cavity.

BRIEF DESCRIPTION OF THE DRAWINGS

FIG. 5 is a fragmentary view of the apparatus of FIG. 1 showing an optional pocket thereon for holding memorabilia and the like;

DETAILED DESCRIPTION OF THE PREFERRED EMBODIMENTS OF THE INVENTION

Figure 1:
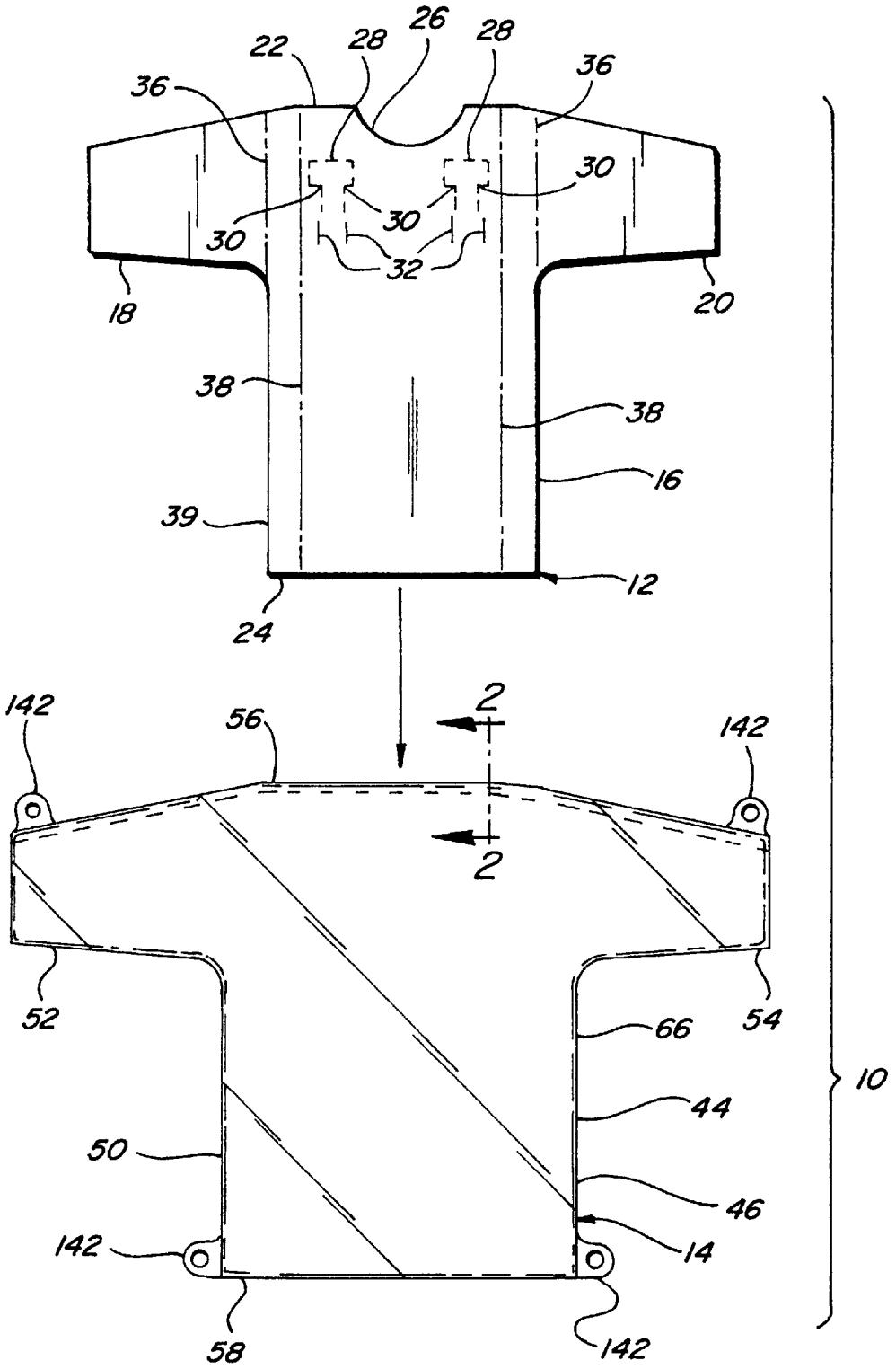
FIG. 1 is a front view and a rear view of apparatus for displaying and protecting a garment according to the present invention.
Figure 10:
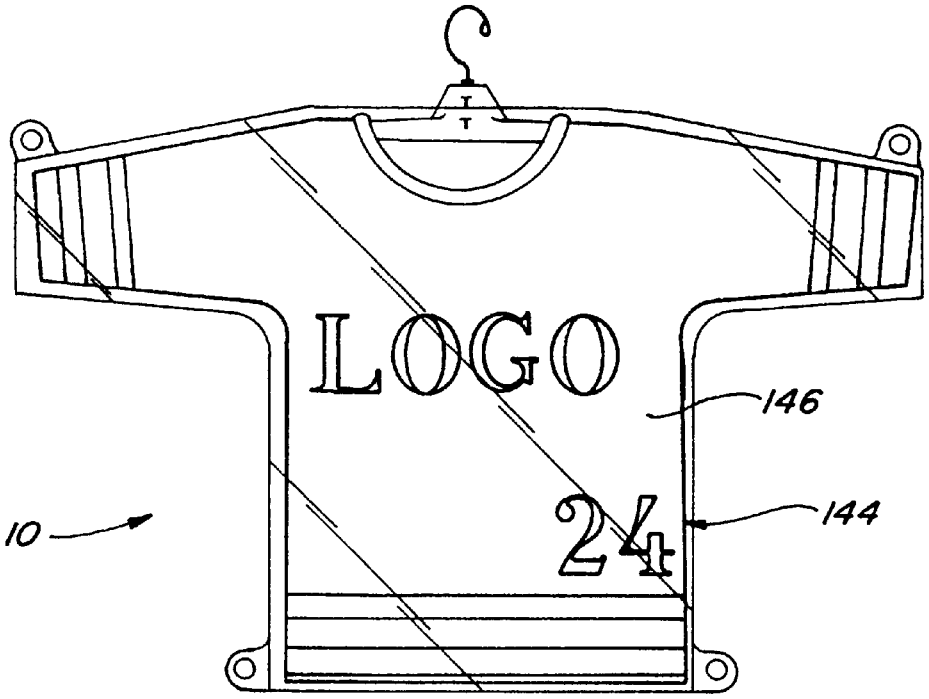
FIG. 10 is a front view of the apparatus of FIG. 1 showing a sports jersey displayed and protected therein.
Figure 11:
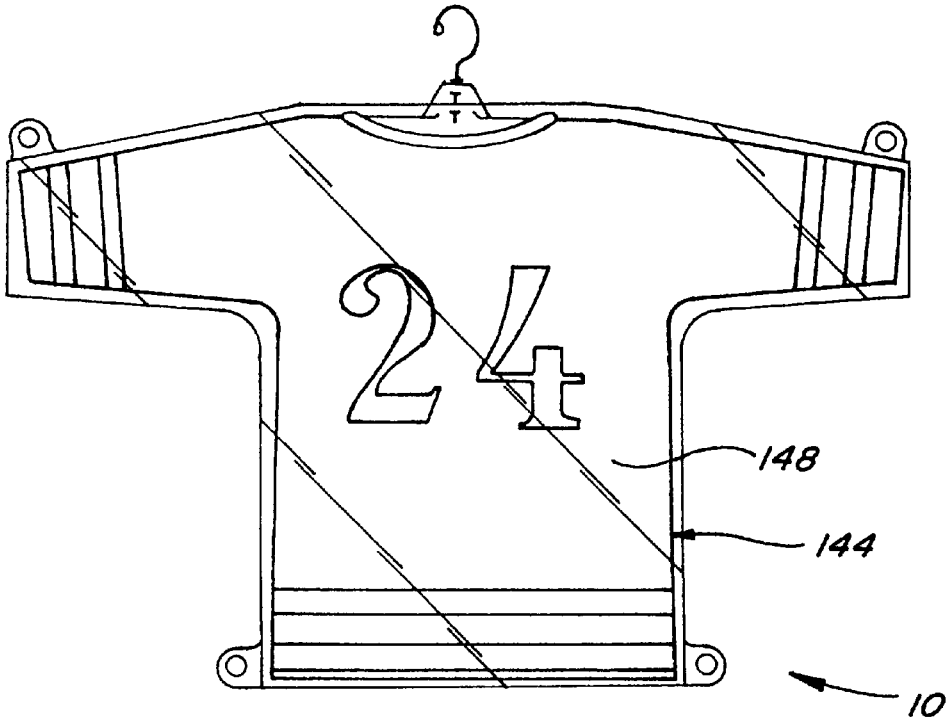
FIG. 11 is a rear view of the apparatus of FIG. 1 showing the rear of the jersey of FIG. 10.

Referring now to the drawings wherein like numerals refer to like parts, the number 10 in FIG. 1 refers to apparatus constructed and operable according to the teachings of the present invention for displaying and protecting a garment in an unfolded condition. Apparatus 10 has utility for displaying and protecting a wide variety of garments to be worn over the upper portion of a person's torso, including shirts, athletic jerseys, blouses, tunics, jackets, coats, and the like. Importantly, when protected by the present apparatus 10, virtually the complete garment, including both the front and rear surfaces thereof are fully and prominently displayed, as shown in FIGS. 10 and 11.

Figure 3:
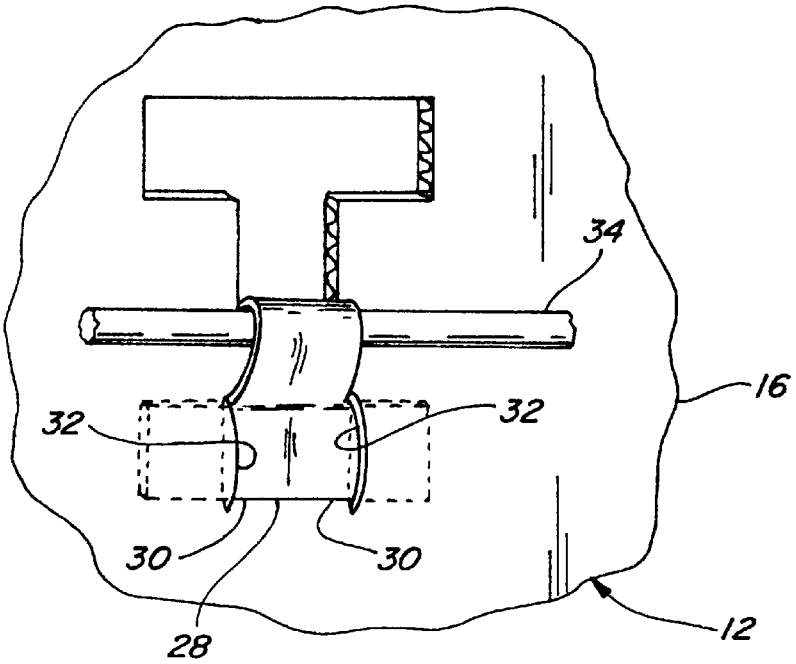
FIG. 3 is a fragmentary view of the apparatus of FIG. 1 showing optional structure thereof for attaching a typical prior art clothes hanger thereto.

Apparatus 10 includes an inner backing member 12 which is placed in the shirt, jersey or other garment, and an outer protective envelope for cooperatively receiving the shirt, jersey or other garment with the inner backing member 12 located therein in supportive relation thereto. Inner backing member 12 is a generally planar member made from corrugated cardboard or other generally rigid material, and includes a main body portion 16 and a pair of limb portions 18 and 20 integrally formed with or attached to body portion 16 at locations corresponding to the locations of the sleeves of a shirt, jersey or other garment. Body portion 16 is of generally rectangular shape having an upper end portion 22 and an opposite lower end portion 24. Body portion 16 includes an optional cut-out 26 located at a location generally corresponding to the location of the collar or neck of a shirt or jersey, and a plurality of optional pre-cut tabs 28 having ears 30 cooperatively receivable in pre-cut slits 32 for forming a loop for holding a conventional clothes hanger 34, as best shown in FIG. 3, for supporting apparatus 10 and a garment from a clothes rod or other conventional device (not shown). Body portion 16 includes a plurality of folding lines 36 and/or 38 extending longitudinally therealong between upper end portion 22 and lower end portion 24, which folding lines 36 and 38 enable folding inner backing member 12 to facilitate insertion of limb portions 18 and 20 into the sleeves of a shirt or jersey, or through the shoulder loops of a sleeveless garment, such as a basketball jersey or the like.

Backing member 12 has an outer peripheral edge portion 39 extending around body portion 16 and limb portion 18 and 20 defining an outer profile shape that corresponds at least generally to the outer profile shape of a shirt, jersey or other upper body garment when viewed from the front or rear in an unfolded condition. Thus, when placed in the garment, backing member 12 is operable to support the garment in the unfolded condition such that substantially all of the front and rear surfaces are visible. In this regard, it is contemplated that backing member 12 can be provided in a wide variety of different shapes and sizes corresponding to the shapes and sizes of a wide variety of garments, including, but not limited to, men's garments, women's garments, and children's garments.

Figure 2:
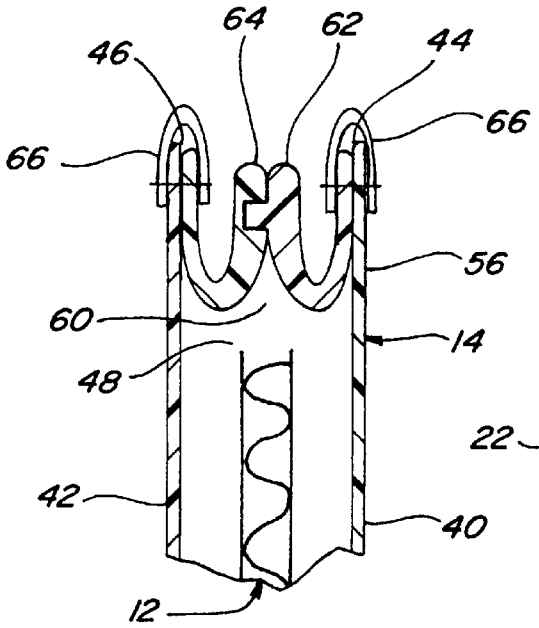
FIG. 2 is a fragmentary cross sectional view taken along line 2—2 of FIG. 1 showing one embodiment of closure structure of the apparatus.

Referring also to FIG. 2, outer protective envelope 14 is a generally planar but more flexible member constructed of overlapping transparent plastic film members 40 and 42 having overlaying peripheral edge portions 44 and 46 sewn or otherwise joined together so as to form an interior cavity 48. Outer protective envelope 14, like inner backing member 12, includes a main body portion 50 of generally rectangular shape and a pair of limb portions 52 and 54 integrally formed with main body portion 50. Outer protective envelope 14 has an upper end portion 56 and a lower end portion 58, upper end portion 56 including an opening 60 in communication with internal cavity 48 extending substantially the width thereof between opposite ends of limb portion 52 and limb portion 54, and closure members 62 and 64 such as Zip Loc brand tongue and groove closure members or the like cooperatively engagable for sealably closing opening 60 as shown. Opening 60 is sufficiently large to allow the passage of backing member 12 with a garment thereover into and out of internal cavity 48, backing member 12 being bendable along folding lines 36 and/or 38 to facilitate insertion and removal, as required. Closure members 62 and 64 are sewn or otherwise attached together along their lengths to edge portions 44 and 46, respectively, of film members 40 and 42, reinforced by fabric edge members 66, one of which fabric edge members 66 extends completely around overlapping edge portions 44 and 46 of the protective envelope. Overlapping edge portions 44 and 46 define an outer profile shape of protective envelope 14, the profile shape of protective envelope 14 corresponding to that of backing member 12 but being marginally larger to allow insertion of the backing member 12 while contained in a shirt, jersey, etc. into interior cavity 48, as illustrated in FIG. 2.

FIG. 3 shows backing member 12 with one of the tabs 28 with ears 30 thereof cooperatively received in slits 32 in main body portion 16 forming a loop for receiving a rod of a conventional clothes hanger 34.

Figure 4:
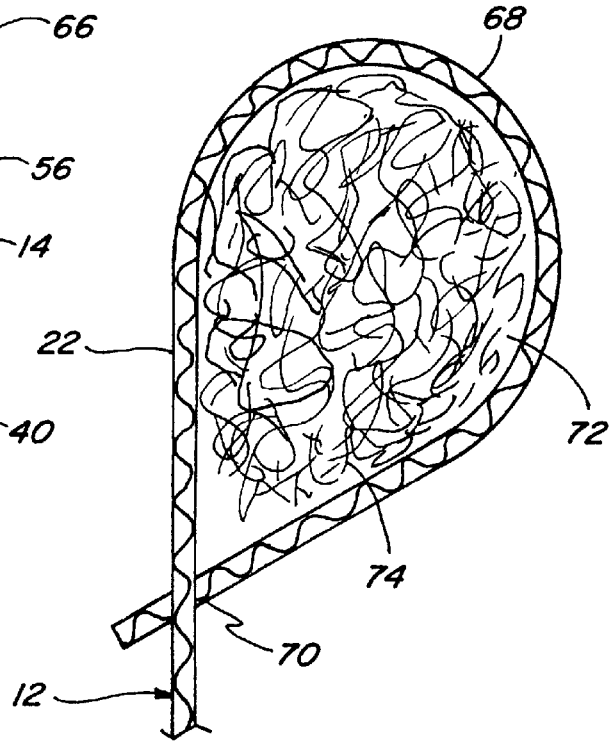
FIG. 4 is a fragmentary cross sectional view of optional structure for the apparatus of FIG. 1 for broadening a shoulder portion of the apparatus for use with athletic jerseys.

FIG. 4 shows an optional feature for the upper end portion 22 of backing member 12, the feature including a pair of flaps 68 extending upwardly from upper end portion 22 of the inner backing member adjacent opposite ends of cut-outs 26, each of the flaps 68 being bendable and insertable into a slit 70 in the backing member as illustrated to form enlarged shoulder portions usable with shirts and jerseys for various sports such as football to give the displayed shirt or jersey a fuller look. Flaps 68 when bent and engaged in slits 70 each form a cavity 72 that can be filled with one or more wads 74 of tissue paper, newspaper or other suitable material for added support as also shown.

Figure 5:
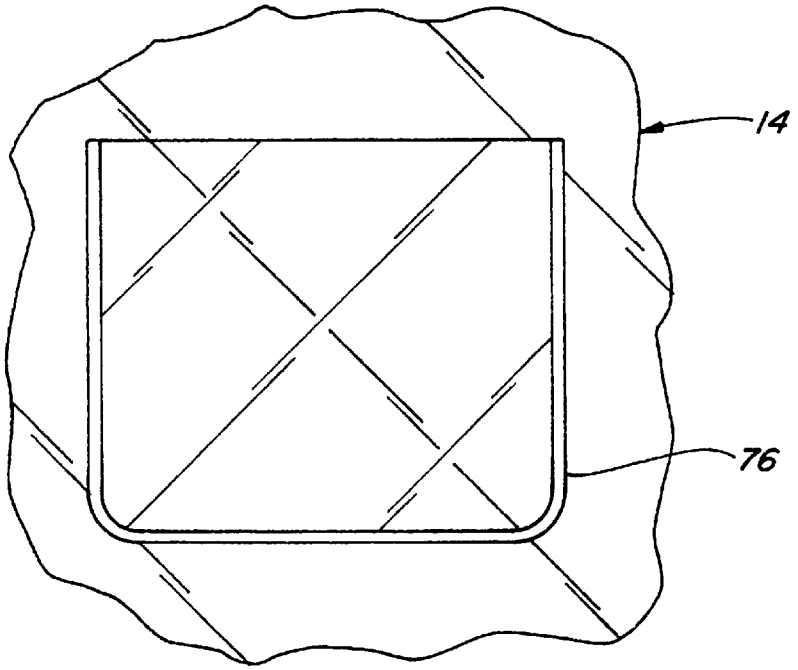

FIG. 5 shows another optional feature for apparatus 10, a pocket 76 open at one end and also made of a transparent plastic film material that can be located at any desired location on outer protective envelope 14 for holding memorabilia associated with a garment displayed and protected therein, such as a ticket stub for a sporting event, concert, or the like. Pocket 76 can be sufficiently large to hold a document such as a letter of authenticity, an autographed program, or the like, as desired.

Figure 6:
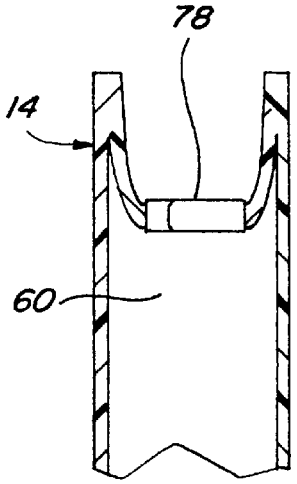
FIG. 6 is a fragmentary cross sectional view of the apparatus of FIG. 1 showing alternative closure structure associated therewith.

FIG. 6 shows an alternative closure member for opening 60 of protective envelope 14, which is a zipper 78 constructed and operable in the conventional manner. Here it should be noted that it is contemplated that any portion of the outer peripheral edge of the protective envelope can include the opening for insertion and removal of the garment, including a lower edge portion or either side edge portion, as desired.

Figure 7:
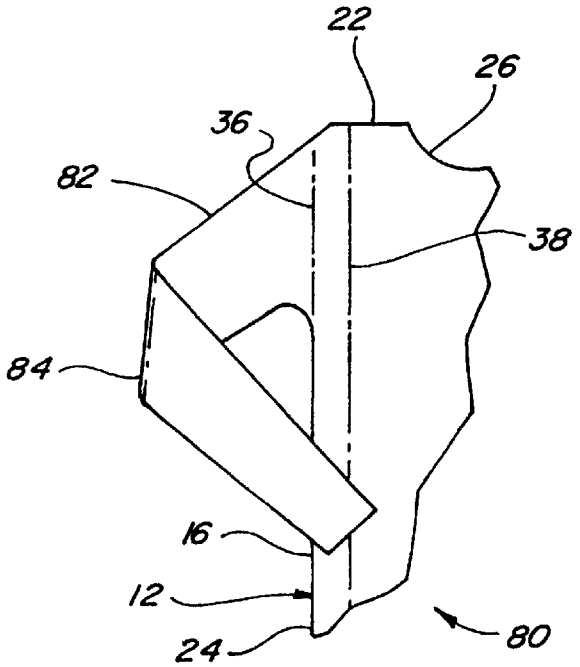
FIG. 7 is a fragmentary front view of alternative apparatus for displaying and protecting a garment according to the present invention.

FIG. 7 shows an alternate backing member 80 according to the teachings of the present invention, like elements of backing member 80 and backing member 12 of apparatus 10 being identified with like numerals. Backing member 80 is the same in many respects as backing member 12 of apparatus 10, the primary difference being the improved ability of backing member 80 for displaying and protecting shirts, jerseys and the like having longer sleeves. Backing member 80 is of generally planar, rigid construction made from corrugated cardboard or the like and includes a main body portion 16 having an upper end portion 22 and an opposite lower end portion 24, upper end portion 22 including a cut-out 26, and the main body portion including folding lines 36 and 38 extending between upper end portion 22 and lower end portion 24. Likewise, main body portion 16 can include tabs 28 including ears 30 for insertion in slits 32 (FIGS. 1 and 3) for attachment of a conventional clothes hanger thereto. Backing member 80 includes a pair of longer limb portions 82 extending outwardly from upper end portion 22 of main body portion 16, each of the longer limb portions 82 preferably having at least one folding line such as the folding line 84 located along its length to enable insertion of the longer limb portion 82 into a longer sleeve of a shirt or jersey, such as a jersey used for hockey or the like. Backing member 80 is contemplated for use with an outer protective envelope (not shown) constructed and operable in the same manner as protective envelope 14 disclosed and discussed above but having corresponding longer limb portions. Additionally, here it should be understood that it may be desired to display long sleeve garments and the like with the sleeves folded for economy of space or for appearance purposes. Accordingly it is contemplated that the distal ends of the limb portion of the protective envelope may be optionally attachable to the body portion thereof for such purpose. Backing member 80, like backing member 12 of apparatus 10, can also include other above discussed features, such as optional flaps 68 for enlarging the upper end portion thereof to give a fuller look in the shoulder area of the garment. Here, it should be recognized and understood that when flaps 68 are used with either backing member 12 or 80, the outer protective envelope used can be sized so as to have an internal cavity correspondingly larger in any desired dimension for receiving the enlarged upper portion of the backing member.

Figure 8:
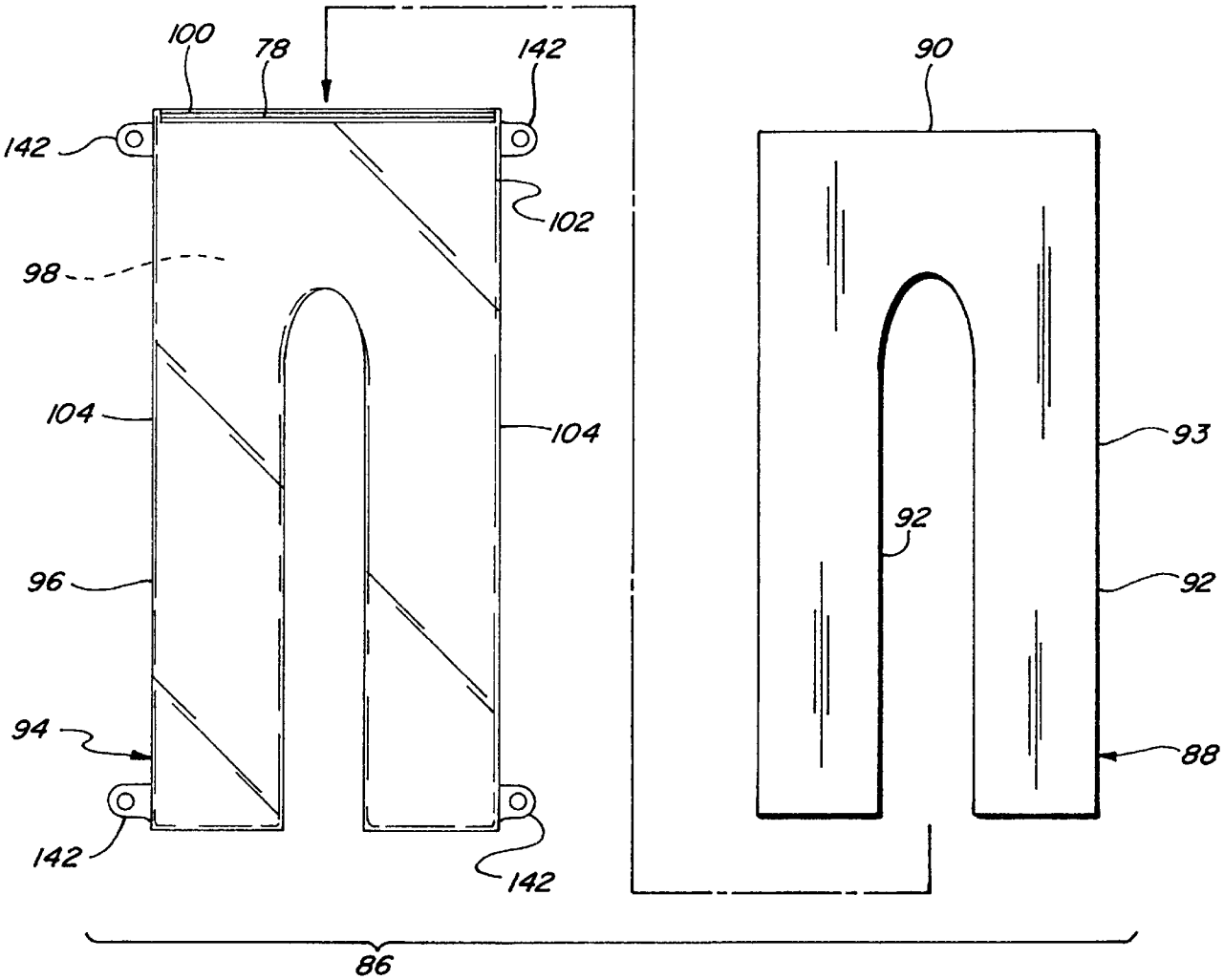
FIG. 8 is a front view of another alternative apparatus for displaying and protecting a garment according to the present invention.

Turning to FIG. 8, another apparatus 86 according to the present invention for displaying and protecting a garment is shown, like parts of apparatus 86 and apparatus 10 being identified by like numbers. Apparatus 86, unlike apparatus 10, is adapted for displaying and protecting a garment for a person's lower body, such as, but not limited to, a pair of pants or trousers. Apparatus 86 includes an inner backing member 88 of generally planar, rigid construction made from corrugated cardboard or the like and including a main body portion 90 and a pair of elongated limb portions 92 extending outwardly from main body portion 90 in generally parallel relation. Inner backing member 88 is adapted to be placed into a pair of pants or trousers with main body portion 90 located in the crotch and limb portions 92 positioned in the leg portions thereof to support the pants or trousers in an unfolded condition.

Inner backing member 88 has an outer peripheral edge 93 extending around main body portion 90 and limb portions 92 defining a profile shape corresponding to the profile shape of a pair of pants or trousers when in an unfolded condition such that the front and rear surfaces thereof are substantially fully visible.

Outer protective envelope 94 is a generally planar flexible member constructed of overlaying film members having overlaying outer peripheral edge portions 96 joined together to form an internal cavity 98. Outer protective envelope 94 further includes an open upper end 100 communicating with internal cavity 98 and including a reclosable closure member such as the zipper 78 or Zip Loc brand closure to allow sealable closure thereof. Protective envelope 94 includes a main body portion 102 and a pair of limb portions 104. Edge portion 96 of protective envelope 94 defines a profile shape corresponding to, but marginally larger in size than the profile shape of inner backing member 88, such that the inner backing member when located in a pair of pants or trousers can be inserted through open upper end 100 into internal cavity 98 of the protective envelope and the zipper 78 or other closure member sealably closed to contain and protect the pants or trousers.

Figure 9:
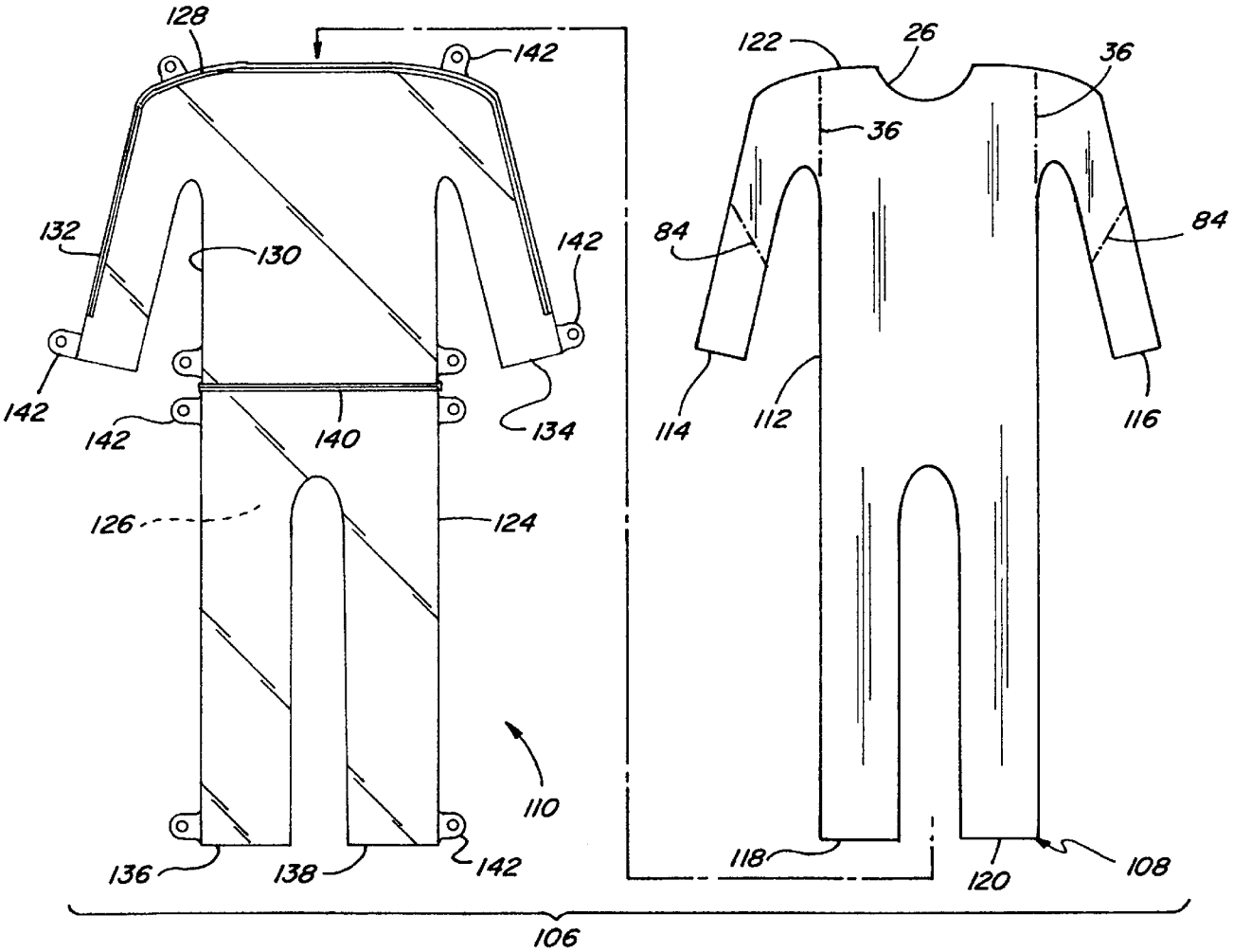
FIG. 9 is a front view of still another alternative apparatus for displaying and protecting a garment according to the present invention.

FIG. 9 shows still another apparatus 106 according to the present invention for displaying and protecting a garment, the apparatus 106 being adapted for displaying and protecting an outfit including a shirt or jersey and pants or trousers, or alternatively, a full body suit such as a racing suit or the like. Apparatus 106 includes an inner backing member 108 and an outer protective envelope 110. Inner backing member 108 is of generally planar construction made from corrugated cardboard or material having similar properties and has a main body portion 112 and four attached limb portions 114, 116, 118 and 120. Main body portion 112 is adapted to be placed in the portion of the garment for covering a person's torso, limb portions 114 and 116 being adapted to be placed in the sleeves or arm portions of the garment, and limb portions 118 and 120 being adapted to be placed in the leg portions of the garment. Further in this regard, limb portions 114 and 116 as shown have a length corresponding to a long sleeved garment, but likewise could be shorter for use with a short sleeved garment with equal utility. Limb portions 114 and 116 additionally include folding lines 36 and 84 to allow folding the limb portions for insertion into the sleeves or arms of the garment. Still further, main body portion 112 includes an optional cut-out 26 positioned to corresponding location to the neck or collar of a garment. Finally, inner backing member 108 includes an outer peripheral edge 122 extending therearound defining a profile shape which can be tailored as desired to fit the profile shape of a garment to be displayed and protected, as explained above.

Outer protective envelope 110 is constructed in the same manner as outer protective envelopes 14 and 94, including overlaying plastic film layers joined together along their common outer peripheral edge portions 124 to form an internal cavity 126 and including an open upper end 128 to allow for insertion of inner backing member 108 having a garment located thereover into internal cavity 126. Outer protective envelope 110 includes a main body portion 130 with attached limb portions 132, 134, 136 and 138 corresponding, respectively, to limb portions 114, 116, 118 and 120 of inner backing member 108. Common outer peripheral edge portions 124 defines a profile shape which generally corresponds to that of inner backing member 108 to allow insertion of the inner backing member when located in a garment into outer protective envelope 110 to be displayed and protected therein as discussed above. As an option, outer protective envelope 110 can be of two piece construction joined together at a location on main body portion 130 using suitable structure, such as a conventionally constructed and operable zipper 140 for better handling and utility.

The outer protective envelopes 14, 94 and 110 of the above described apparatus can additionally include optional grommets 142 at various locations along the edges thereof for use with hooks, thumb tacks, nails and/or other fasteners for mounting the apparatus to a wall or the like as shown in various of the figures. The outer protective envelopes can also be provided with a coating or the like to filter ultraviolet light to limit damage to garments contained therewithin from the light.

Turning to FIGS. 10 and 11, apparatus 10 is shown with a garment 144 displayed and protected therein in an unfolded condition, garment 144 being a sports jersey having indicia on both the front and back surfaces 146 and 148 thereof which are fully visible.

Figure 12:
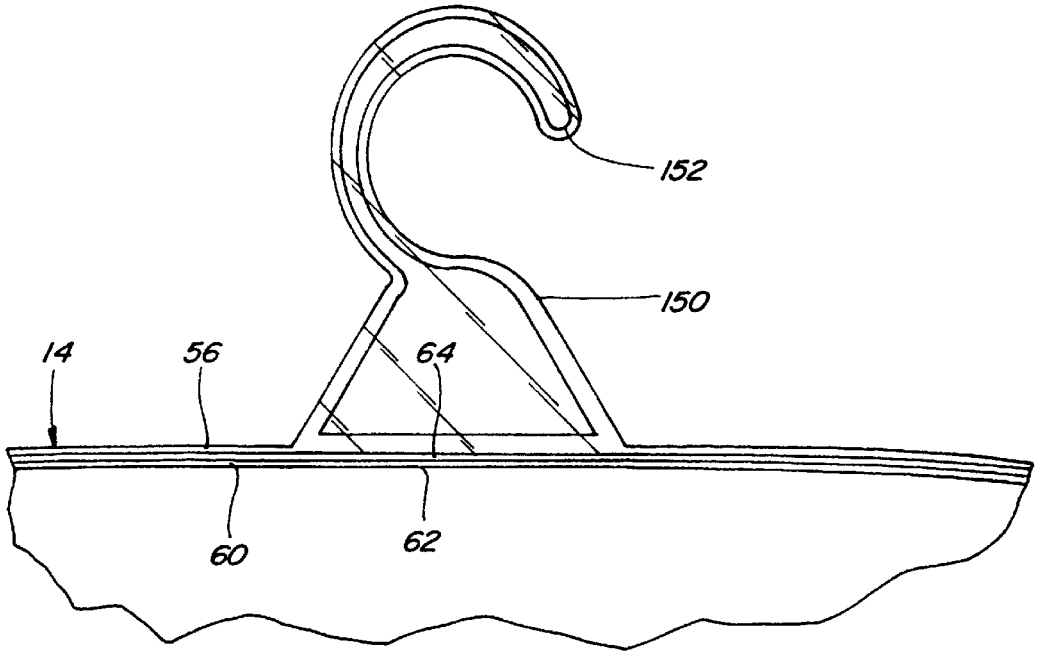
FIG. 12 is a fragmentary front view of an alternative protective envelope including a hanger portion thereon.

FIG. 12 shows outer protective envelope 14 including an optional hanger portion 150 attached to upper end portion 56 thereof. Hanger portion 150 is made from overlapping film members sealed together along their outer peripheral edge portions forming a cavity for receiving a generally arcuate shaped reinforcing member 152 adapted for supporting apparatus 10 containing inner backing member 12 and a garment located thereon from a clothes rod or other member. When use of hanger portion 150 is not desired, the hanger portion can be cut or torn from protective envelope 14, or simply folded over either of the film members thereof in an out of the way position. FIG. 12 also show the relationship of hanger portion 150 to opening 60 and closure members 62 and 64.

Figure 13:
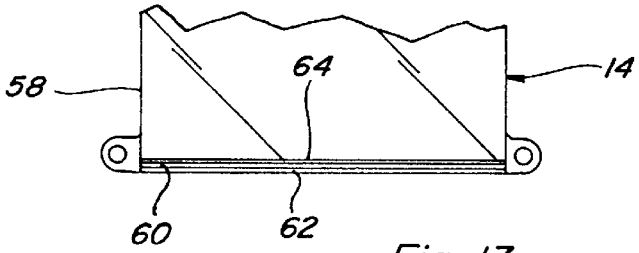
FIG. 13 is a fragmentary front view of an alternative protective envelope including an opening at the bottom thereof and closure structure associated therewith.

FIG. 13 shows outer protective envelope 14 including opening 60 along the bottom most edge of lower end portion 58 thereof, and closure members 62 and 64 operable for closing the opening.

Thus there has been shown and described a novel invention in apparatus for displaying and protecting a garment. Other aspects, objects and advantages of the present invention can be obtained from a study of the drawings, the disclosure and the appended claims.

What is claimed is:

1. Apparatus for displaying and protecting a garment in an unfolded condition, said apparatus comprising:

a generally planar backing member of at least generally rigid construction including a body portion and at least two limb portions attached to the body portion at locations corresponding to the locations of at least two limb receiving members of the garment, the backing member having an outer profile shape corresponding at least generally to an outer profile shape of the garment when in an unfolded condition and being insertable into the garment such that front and rear outer surfaces of the garment are substantially visible; and a protective envelope constructed of overlapping generally transparent film members having outer peripheral edge portions joined together forming an interior cavity between the film members, the protective envelope having a body portion and at least two limb portions attached thereto, the protective envelope having a profile shape corresponding to and marginally larger than the profile shape of the backing member and an opening communicating with the interior cavity adapted for passage of the garment with the backing member received therein into and out of the interior cavity.

2. Apparatus, as set forth in claim 1, wherein the protective envelope includes a hanger portion.

3. Apparatus, as set forth in claim 1, wherein the protective envelope is operable to limit the penetration of ultraviolet light into the interior cavity thereof.

4. Apparatus, as set forth in claim 1, wherein the backing member includes at least one member cooperatively engagable with a clothes hanger to allow using the clothes hanger for hanging the apparatus.

5. Apparatus, as set forth in claim 1, wherein the garment is a sleeveless sports jersey having shoulder loops and the limb portions of the backing member are adapted for insertion therein.

6. Apparatus, as set forth in claim 1, wherein the garment is a pair of pants and the limb portions of the backing member are adapted for insertion into leg portions of the pants.

7. Apparatus, as set forth in claim 1, wherein the protective envelope includes at least one pocket for holding and displaying memorabilia.

8. Apparatus, as set forth in claim 1, wherein the protective envelope comprises at least one closure member to allow closing the opening in communication with the interior cavity thereof.

9. Apparatus, as set forth in claim 8, wherein the at least one closure member comprises cooperatively engagable tongue and groove members.

10. Apparatus, as set forth in claim 8, wherein the at least one closure member comprises a zipper.

11. Apparatus, as set forth in claim 1, wherein the overlapping film members of the protective envelope are fused together along a common edge.

12. Apparatus, as set forth in claim 1, wherein the garment is a suit having a pair of sleeves and a pair of pant legs and the backing member and the protective envelope each comprise corresponding limb portions.

13. Apparatus, as set forth in claim 12, wherein the protective envelope comprises an upper portion and a lower portion detachably joined together.

14. Apparatus, as set forth in claim 1, wherein the backing member has at least one folding line along which the backing member can be folded to facilitate insertion of the limb portions thereof into the garment.

15. Apparatus, as set forth in claim 1, wherein the backing member comprises an upper end portion including a pair of flaps bendable and attachable to the backing member to make shoulder portions of a garment located thereover appear fuller.

16. Apparatus, as set forth in claim 1, wherein the protective envelope comprises at least one member adapted for supporting the apparatus on a wall or other surface.

17. Apparatus, as set forth in claim 1, wherein the film members of the protective envelope comprise a plastics material.

18. Apparatus, as set forth in claim 1, wherein the backing member is made from a corrugated cardboard material.

19. Apparatus, as set forth in claim 1, wherein the joined together edge portions of the protective envelope are reinforced.

20. Apparatus, as set forth in claim 1, wherein the garment is a shirt or jersey having long sleeves and the limb portions of the apparatus correspond in length thereto.

* * * * *